US005257851A

United States Patent [19]

Kanaya

[11] Patent Number: 5,257,851

[45] Date of Patent: Nov. 2, 1993

[54] SHAMPOO CHAIR

[75] Inventor: Mashiro Kanaya, Flemington, N.J.

[73] Assignee: Takara Belmont U.S.A., Inc., Somerset, N.J.

[21] Appl. No.: 823,179

[22] Filed: Jan. 21, 1992

[51] Int. Cl.[5] ..... A47C 1/02

[52] U.S. Cl. ..... 297/344.13; 297/344.16

[58] Field of Search ..... 297/344, 345, 346; 4/561, 562, 563

[56] References Cited

U.S. PATENT DOCUMENTS

| | | | |
|---|---|---|---|
| 2,332,904 | 9/1943 | Ellinger . | |
| 2,712,346 | 7/1955 | Sprinkle | 297/345 X |
| 3,810,673 | 5/1974 | Shoji | 297/346 |
| 4,092,009 | 5/1978 | Koutski | 297/345 X |
| 4,918,767 | 4/1990 | Benting . | |

*Primary Examiner*—Laurie K. Cranmer

*Attorney, Agent, or Firm*—Polster, Lieder, Woodruff & Lucchesi

[57] ABSTRACT

A shampoo chair for positioning its occupant comfortably for a shampoo at a shampoo bowl includes a base which rests on a floor in front of the shampoo bowl and has tracks, a carriage which moves along the tracks of the base, a fluid-operated cylinder which is mounted on the carriage, and a chair form which is supported on the cylinder and has a seat panel over which a seat cushion lies and a back panel to which a backrest is attached. The carriage gives the chair form horizontal movement toward and away from the shampoo bowl, while the cylinder elevates the chair form generally vertically. Between the two movements the chair form may be positioned to accommodate individuals of varying stature to the shampoo bowl. The carriage is provided with a carriage lock which includes eccentric elements that lie over the tracks. When the elements are turned, they bear against the tracks and prevent the carriage from moving along the base. In the alternative, the locking elements may be mounted on the base, so that when they are turned, they bear against the carriage.

19 Claims, 3 Drawing Sheets

FIG. 1.
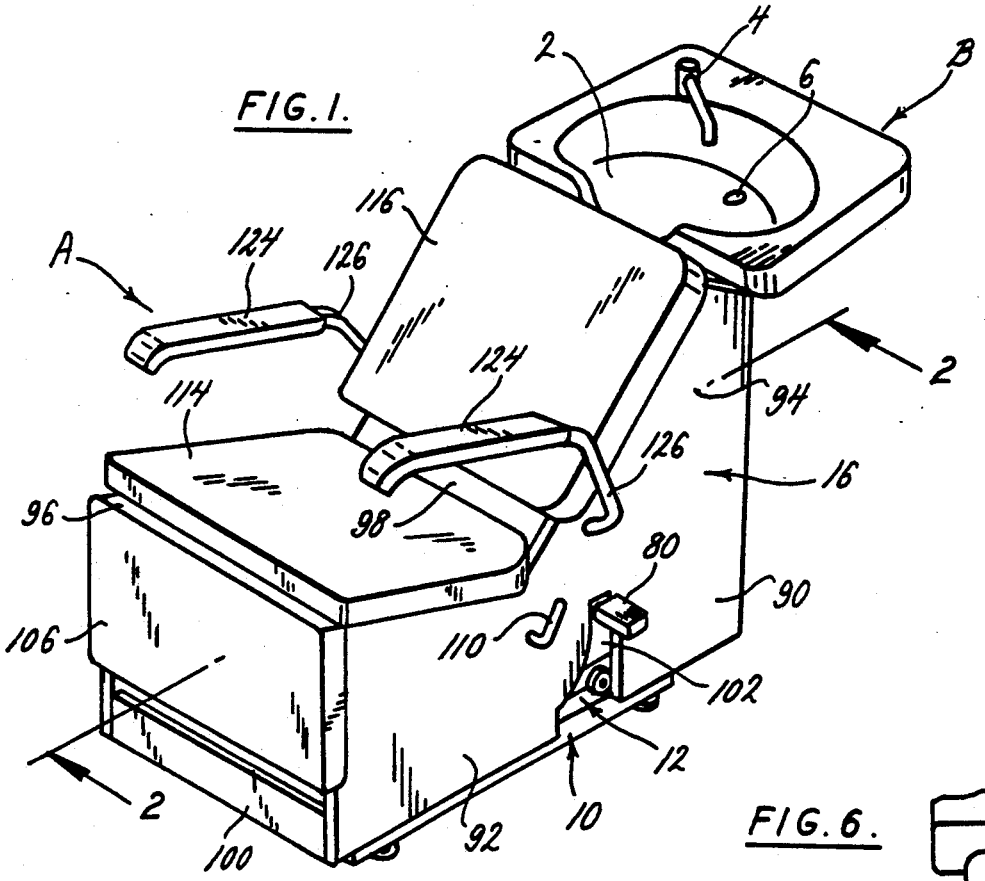
FIG. 6.
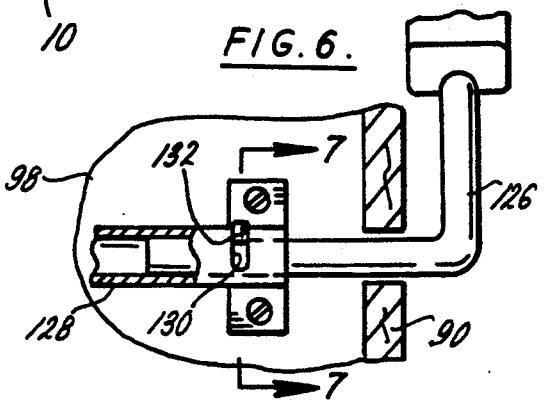
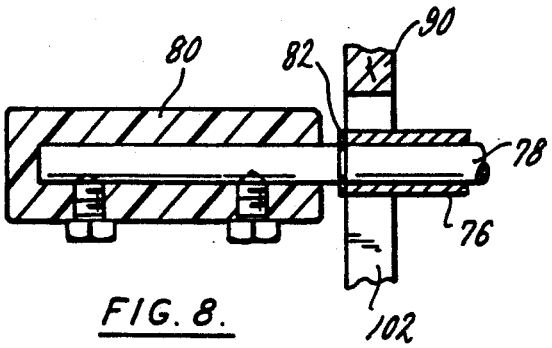
FIG. 8.
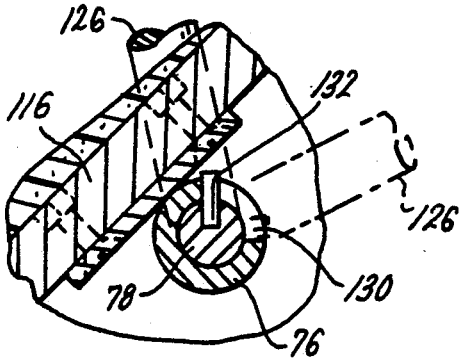
FIG. 7.

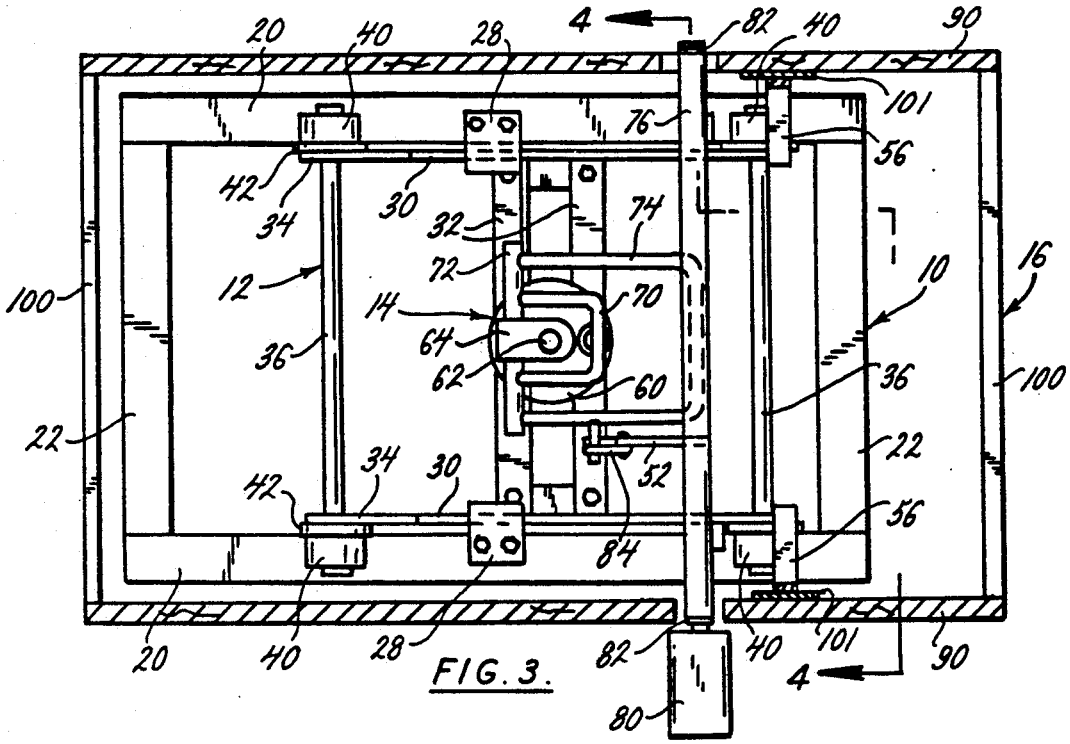
FIG. 3.
FIG. 4.
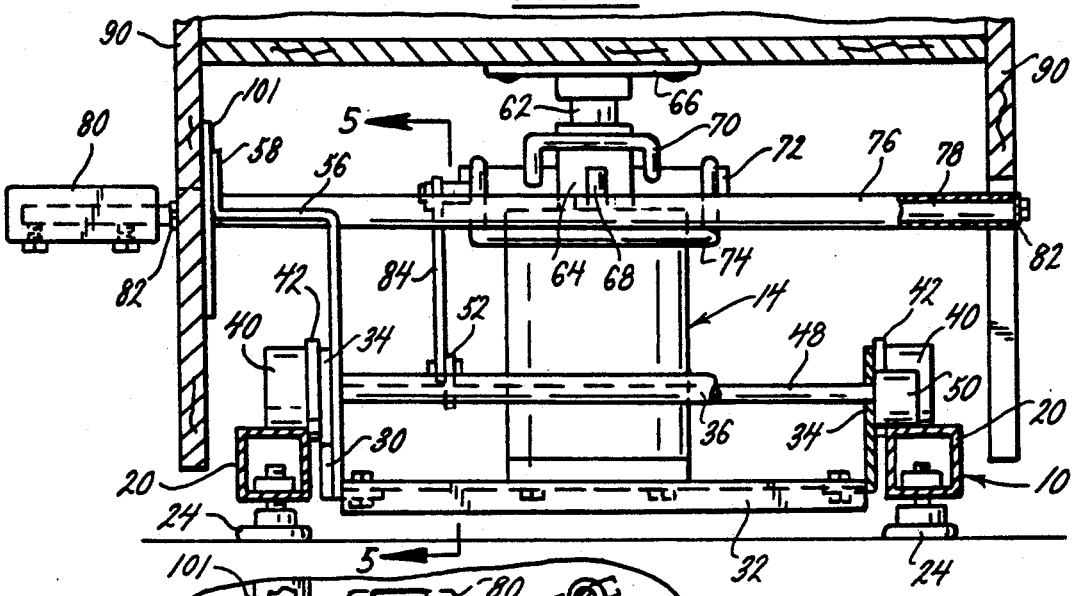
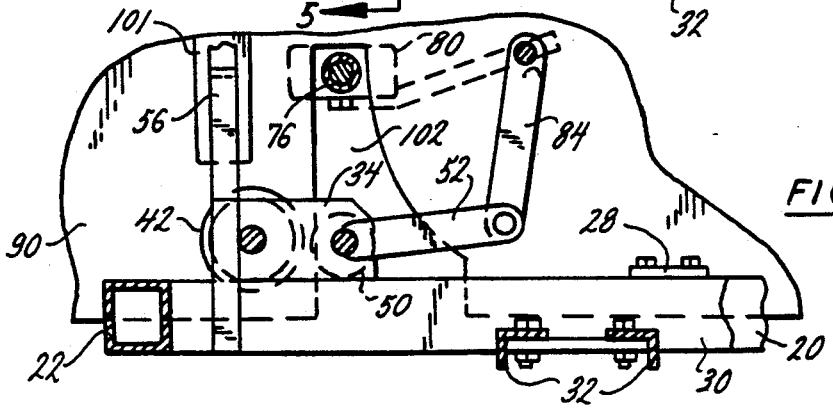
FIG. 5.

SHAMPOO CHAIR

BACKGROUND OF THE INVENTION

This invention relates in general to chairs and more particularly to a chair in which one may sit to receive a shampoo.

The traditional barber chair moves upwardly and downwardly to position the occupant at a height which is convenient for the barber to give the occupant a haircut, and while barbers are called upon to shampoo hair as well as give haircuts, the traditional barber chair is much too upright and high, even when in its lowest elevation, to position a seated occupant for a shampoo. However, the back rest on the traditional barber chair reclines to place the occupant's head at a counter-height shampoo bowl normally located behind the chair. The occupant of the chair also reclines, but many individuals prefer to remain in a seated position when receiving a shampoo. Moreover, the barber chair, being quite heavy, cannot be moved toward and away from the shampoo bowl to accommodate individuals of different size, and accordingly the occupant must accommodate himself to the shampoo bowl by shifting his position in the chair. This may place the occupant in an uncomfortable position for the shampoo.

Aside from that, beauty shops rarely use traditional barber chairs, yet give as many shampoos as barber shops. They use lower chairs, a variety of which exist, for bringing an occupant's head to a shampoo bowl, so that the occupant may receive a shampoo. Some of these chairs are simply referred to as shampoo chairs.

The present invention resides in a chair which is ideally suited for use with a shampoo bowl located behind the chair to give the occupant a shampoo at the bowl. The chair includes a chair form having seat and backrest, and the chair form moves as a unit upwardly and downwardly on a cylinder and also toward and away from the shampoo bowl on a carriage. This enables the chair to bring the occupant's head to a position suitable for receiving a shampoo at the shampoo bowl, while still having the occupant comfortably seated in the chair.

DESCRIPTION OF THE DRAWINGS

In the accompanying drawings which form part of the specification and wherein like numerals and letters refer to like parts wherever they occur:

FIG. 1 is a perspective view of a shampoo chair and shampoo bowl, with the chair being constructed in accordance with and embodying the present invention;

FIG. 3 is a sectional view of the chair taken along line 3—3 of FIG. 2 and showing in plan the carriage and base upon which the carriage moves;

FIG. 4 is a sectional view taken along line 4—4 of FIG. 3 and showing the carriage and cylinder in elevation, with a portion of the carriage being broken away to show the carriage lock;

FIG. 5 is a sectional view taken along line 5—5 of FIG. 3 and showing the linkage for operating the carriage lock;

FIG. 6 is a fragmentary sectional view taken along line 6—6 of FIG. 2 and showing one of the arm rests where it is mounted on the chair form;

FIG. 7 is a sectional view taken along line 7—7 of FIG. 6 and showing the mount for the carriage lock;

FIG. 8 is an enlarged fragmentary sectional view showing the pedal for operating the pump and carriage lock;

DETAILED DESCRIPTION

Figures 2, 9, 10, 11:
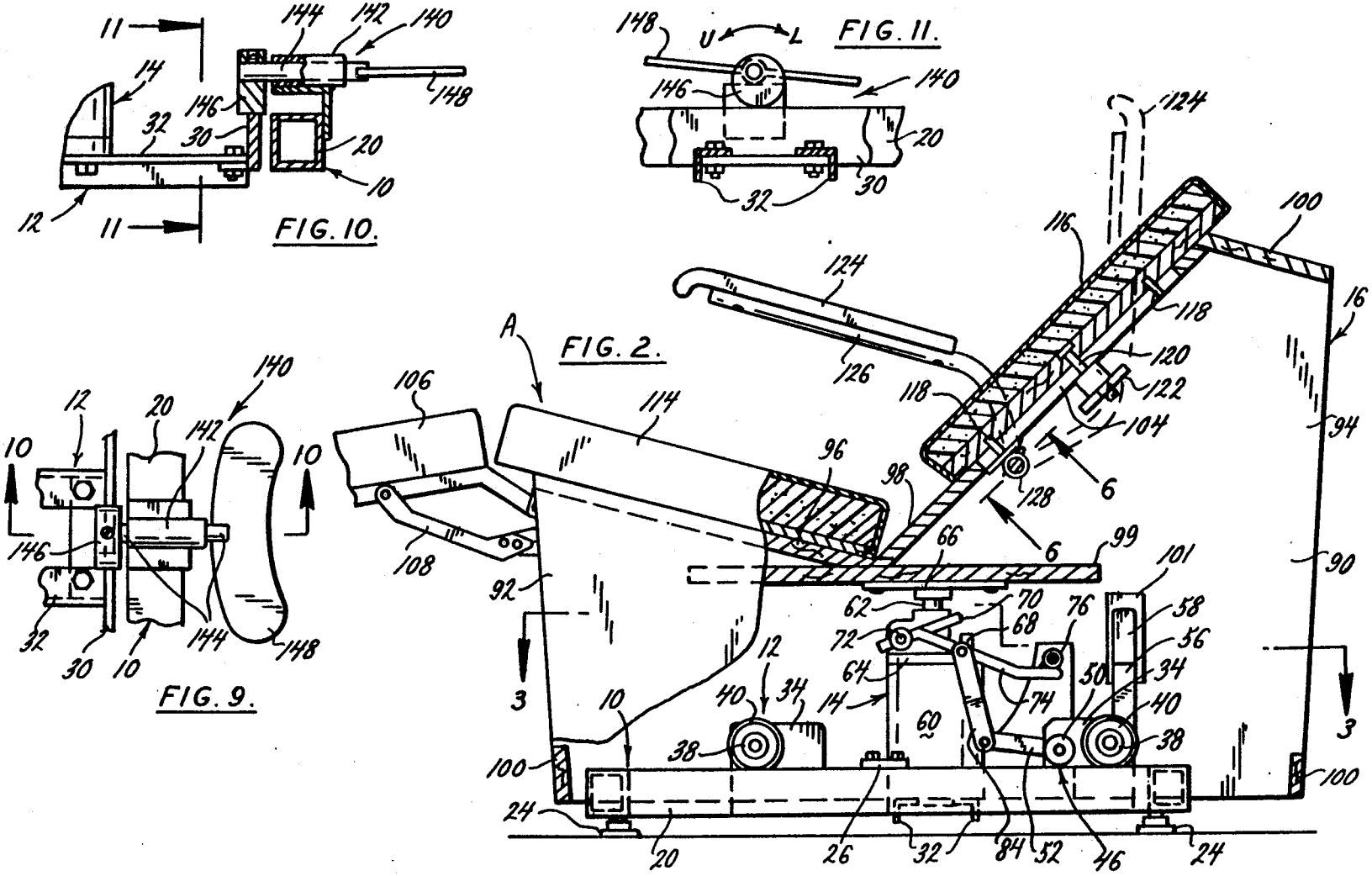
FIG. 2 is a sectional view of the chair taken along line 2—2 of FIG. 1.
FIG. 9 is a plan view of a modified carriage lock.
FIG. 10 is a sectional view of the modified carriage lock taken along line 10—10 of FIG. 9.
FIG. 11 is an end elevational view of the modified carriage lock taken along line 11—11 of FIG. 10.

Referring now to the drawings, a chair A (FIG. 1) is located in front of a shampoo bowl B and positions its occupant comfortably at the bowl B where the occupant may receive a shampoo. The chair A also allows space for a barber or beautician to work comfortably alongside it while giving the shampoo. The bowl B is normally set into a counter or cabinet, yet projects forwardly toward the chair A. Here the bowl B is provided with a depression 2 which is configured to comfortably accept the neck of an individual sitting in the chair and receiving a shampoo. The bowl B also has a faucet 4 for supplying hot and cold water and a drain 6 for directing water collected in it into a waste line. The chair A includes a base 10 which is located on a floor in front of the bowl B, a carriage 12 which moves on the base 10, an elevating cylinder 14 mounted on the carriage 12, and a chair form 16 mounted on the cylinder 14. The chair A is such that its chair form 16 moves upwardly and downwardly with respect to the floor and toward and away from the shampoo bowl B.

Turning now to the base 10, it is in essence a rectangular frame formed from tubular steel members of rectangular cross-section (FIGS. 2–4). The tubular members along the sides of the frame form tracks 20 on which the carriage 12 moves, while the members at the end of the frame serve as end members 22 which maintain the proper spacing between the tracks 20 and provide stops for the carriage 12. The base 10 at its corners is fitted with threaded legs 24 which may be adjusted relative to the tracks 20 to level the base 10 on an uneven floor. Both of the tracks 20 generally midway between their ends have keepers 26 (FIG. 5) which project inwardly over the sides of the carriage 12 and prevent the carriage 12 from leaving the tracks 20.

The carriage 12 for the most part lies within the base 10, but rests on the two tracks 20 that extend along the sides of the base 10 (FIGS. 2–4). It includes a pair of side bars 30 which lie immediately beneath the keepers 26 and along the inside faces of the two tracks 20 for the base 10, and while the spacing between the bars 30 is only slightly less than the spacing between the two tracks 20, the bars 30 are somewhat shorter than the tracks 20. In addition, the carriage 12 has a pair of cross members 32 which are set close together and extend between the two side bars 30 generally midway between the ends of the bars 30. The ends of the cross members 32 are attached firmly to the side bars 30 near the lower margins of the bars 30 so as not to obstruct the upper surfaces of the bars 30, and here the bars 30 and cross members 32 are joined firmly together with bolts or welds. Thus, the ends of the cross members 32 will pass beneath keepers 26 without interfering with those keepers 26. The cross members 32 have considerable rigidity and are preferably angles or channels with shallow flanges.

At their back ends, the side bars 30 of the carriage 12 are provided with upwardly directed brackets 34 (FIG. 2), and these brackets 34 extend well above the tracks 20 and the keepers 26 located along those tracks 20. The brackets 34 hold axles 36 (FIG. 3) which extend completely across the carriage 12 and project over the tracks 20. One axle 36 extends through the two brackets 34 at the front of the carriage 12, whereas the other extends through the two brackets 34 at the rear of the carriage 12. Beyond the brackets the axles 36 are fitted with bearings 38 (FIG. 2), and the bearings 38 in turn support wheels 40 which rotate on the axles 36 by reason of the bearings 38. The wheels 40 lie over the upper surfaces of the tracks 20 and roll along tracks 20 as the carriage 12 moves to and fro on the base 10. Each wheel 40 has a flange 42 which lies along the inside face of the track 20 on which it rolls, and these flanges 42 give guidance to the carriage 12 and keep its side bars 30 spaced from the inside faces of the tracks 20.

The keepers 26 on the tracks 20 of the base 10 project over the side bars 30 of the carriage 12 and prevent the carriage 12 from lifting off the base 10 (FIG. 3) yet the keepers 26 do not interfere with movement of the carriage along the tracks 20 of the base 10. In this regard, the locations of the keepers 26 are such that the upwardly directed brackets 34 at the ends of the carriage 12 never reach the keepers 26.

The two rear brackets 34 are somewhat larger than the front brackets 34, for they not only carry the axles 36, but further serve as a mount for a carriage lock 46. The carriage lock 46 includes common operating shaft 48 which extends between the rear brackets 34 slightly in front of the flanges 42 on the rear wheels 40 and at its ends is fitted with locking elements 50 which lie over the tracks 20 and are eccentric to the axis of the shaft 48. Normally the elements 50 remain separated from the tracks 20 and do not impede the movement of the carriage 12 along the base 10. However, the eccentricity of the elements 50 is such that when the shaft 48 is rotated, the elements 50 come against the upper surfaces of the tracks 20 and hold the carriage 12 in a fixed position on the base 10. In other words, the elements 50, when rotated against the tracks 20, prevent the carriage 12 from moving on the base 10. The shaft 48 is provided with a crank arm 52 which projects forwardly toward the cross members 32 of the carriage 12.

The rear brackets 34 of the carriage 12 further serve as mounts for guide arms 56 (FIG. 4), there being a separate arm 56 bolted firmly to each bracket 34 behind the rear axle 36. The arms 56 extend upwardly from their respective brackets 34, then turn outwardly over the wheels 40, and then project upwardly again in the form of shoes 58 which lie along opposite inside surfaces of the chair form 16 and prevent the chair form 16 from rotating about the axis of the cylinder 14.

The cylinder 14, which is attached to the carriage 12, is conventional, it being of the type typically used on barber chairs to control the height of the occupant in the chair. It includes (FIGS. 2–4) a barrel 60 which is mounted firmly on the two cross members 32 of the carriage 12 midway between the side bars 30. The barrel 60 projects upwardly from the cross members 32, with its axis perpendicular to the plane of the tracks 20. In addition, the cylinder 14 has a rod 62 which projects out of the upper end of the barrel 60 through an end casting 64, and at its outer end is fitted with a seat flange 66 to which the chair form 16 is attached. The inner end of the rod 62 connects to a piston. Below the piston and rod 62 the barrel 60 contains a hydraulic fluid which, when pressurized sufficiently, drives the piston upwardly, thereby extending the rod 62 from the end casting 64 at the upper end of the barrel 60. This increase in pressure is derived from a pump which is located in the end casting 64 at the upper end of the barrel 60, generally behind the rod 62, and includes an operating rod 68 which projects out of the end casting 64. The pump operating rod 68, which is spring loaded, is depressed with a lever 70 which is connected to a cross shaft 72 that extends across the end casting 64 in front of the piston rod 62. Indeed, the cross shaft 72 rotates in the end casting 64. Aside from the lever 70, which bears against the pump rod 68, the cross shaft 72 is also fitted with an operating lever 74 which extends rearwardly past the casting 64, indeed, on both sides of the casting 64. When the operating lever 74 is depressed, it rotates the cross shaft 72 which in turn drives the end of the lever 70 downwardly to depress the pump rod 68. The pump forces more fluid into the portion of the barrel 60 that is below the piston and the piston rod 62, thereby driving the piston rod 62 upwardly. The pump also includes a valve which releases fluid from the region below the piston when the pump rod 68 is depressed below the point at which the pumping ends. Thus, by depressing the operating lever 74 beyond the normal range of movement for pumping, one can vent the lower region of the barrel 60, and this will allow the piston rod 62 to retract into the barrel 60, assuming that a downwardly directed force is applied to it.

The operating lever 74 is isolated within the interior of the chair form 16 and is not easily accessible (FIGS. 3 & 4). But it does have a tubular actuating arm 76 attached firmly to it behind the barrel 60 and end casting 64. The arm 76 extends transversely with respect to the carriage 12, and like the lever 74 lies within the chair form 16, but its ends are at the sides of the chair form 16. The tubular arm 76 receives a rod 78 to which a pedal 80 is attached The rod 78 extends the full length of the tubular arm 76, projecting beyond both ends, but it projects farther beyond one end than the other, and this is the end to which the pedal 80 is attached. Indeed, the pedal 80 lies beyond the chair form 16 where it can be easily and conveniently depressed (FIG. 8). The pedal rod 78 is retained in the tubular arm 76 by snap rings 82 which fit around the rod 78, indeed into grooves located in the rod 78 immediately beyond the two ends of the arm 76.

The pedal 80 also serves to operate the carriage lock 46. To this end, the operating lever 74 of the cylinder 14 is connected to the crank arm 52 on the operating shaft 48 of the carriage lock 46 by a linkage 84 (FIGS. 2 & 5). Thus, when the operating lever 74 swings downwardly by reason of one depressing the pedal 80, the shaft 48 of the carriage lock 46 rotates and turns the eccentric locking elements 50. But the elements 50 rotate such that the space between them and the tracks 20 increases, so the carriage 12 remains free to move over the base 10. However, when the pedal 80 is raised to thereby swing the operating lever 74 upwardly, the crank arm 52 and operating shaft 48 rotate in the opposite direction, and that rotation is enough to bring the eccentric locking elements 50 against the tracks 20 and thereby prevent movement of the carriage 12 along the base 10.

The cylinder 14 carries the chair form 16 which generally fits around and obscures the cylinder 14, and much of the carriage 12 and base 10 as well. The chair form 16 includes (FIGS. 1 & 2) a pair of side panels 90 which are spaced slightly farther apart than the side bars 30 of the carriage 12 and the tracks 20 of the base 10. Each side panel 90 is somewhat L-shaped in configuration, it having a seat region 92, and a backrest region 94 projecting upwardly from the seat region 92. The two side panels 90 are connected at their respective seat regions 92 by a seat panel 96 and at their backrest regions 94 by a back panel 98. The seat panel 96 has a somewhat horizontal orientation, whereas the backrest panel 98 lies at a substantial angle with respect to the seat panel 96 and likewise with respect to the true vertical. Immediately below the intersection of the seat and back panels 96 and 98, a horizontal panel 99 connects the two side panels 90, and it rests on and is attached to the seat flange 66 of the cylinder 14. Thus, the cylinder 14, by extending its rod 62 from its barrel 60, controls the height of the chair form 16 above the base 10 and the floor on which the base 10 rests. The chair form 16 is further rigidified by several connecting members 100 which extend between the two side panels 90 (FIG. 2). Unless otherwise restrained, the chair form 16 will rotate with respect to the carriage 12 and base 10, but restraint is provided by the guide arms 56, the shoes 58 of which bear against the inside faces of the side panels 90. Actually, the shoes 58 bear against wear plates 101 (FIG. 2) on the side panels 90, so the panels 90 are not damaged by the vertical movement of the chair form 16.

Each side panel 90 has a cutout 102 (FIG. 1) at that end of the tubular actuating arm 76 which is adjacent to it, and the pedal rod 80 projects through one of those cutouts 102. The cutout 102 is long enough to accommodate the vertical movement of the rod 78 when it is depressed to actuate the pump 68 or elevated to actuate the carriage lock 46. The back panel 98, on the other hand, contains a slot 104 (FIG. 2) which lies midway between and parallel to the backrest regions 94 of the side panels 90. The panels 90, 96, 98 and 99 may be cut from plywood and are preferably covered with vinyl or some other attractive material.

At its front, the chair form 16 is fitted with a leg rest 106 (FIGS. 1 & 2) which is padded on its front face, but is otherwise formed from a rigid material such as plywood. Normally the leg rest 106 extends across the front of the chair form 16 and closes the interior of the chair form 16. But the leg rest 106 is connected to the side panels 90 of the chair form 16 through linkages 108 which are in turn coupled to and operated by a handle 110 (FIG. 1) located along one or both of the side panels 90. The linkages 108 are such that when operated with the handle 110, they move the leg rest 106 from a generally vertical position, wherein it closes the front of the chair form 16, to a generally horizontal position in which it forms an extension of the seat panel 96. In the latter position, it functions as a leg rest.

The seat panel 96 of the chair form 16 carries a seat cushion 114 (FIG. 2). Along its back panel 98 the chair form 16 has a backrest 116 which, like the leg rest 106, is formed from plywood that is covered on its forward face with a cushioning material. The backrest 116 lies over and obscures the slot 104 in the back panel 98 and is provided with a pair of guide pins 118 which project into the slot 104, but the spacing between the pins 118 is less than the length of the slot 104. Thus, the pins 118 allow the backrest 116 to move upwardly and downwardly on the back panel 98, but otherwise confine it, so that it cannot be displaced laterally or rotated. In addition, the backrest 116 carries a screw 120 which lies between the two pins 118 and likewise projects into the slot 104, indeed completely through the slot 104. Beyond the back panel 98, the screw 120 is fitted with a thumb wheel 122, which when turned down, clamps the backrest 116 against the back panel 98 and thereby secures it in a fixed position on the chair form 16.

The chair form 16 also has arm rests 124 (FIGS. 1 & 2) which lie along the sides of the seat panels 96 and seat cushion 114, but generally do not obstruct the sides of either. Each arm rest 124 includes a rod 126 which extends laterally out of the backrest region 94 of one of the side panels 90 and from there projects forwardly over the side edge of the underlying seat panel 96, its forward end being free. The opposite end, on the other hand, lies within the interior of the chair form 16 where it fits into a tube 128 which extends across the chair form 16 immediately behind the back panel 98 (FIG. 6). Indeed, the tube 128 is fastened firmly to the back panel 98 so it can neither rotate nor shift axially. At its ends, the tube 128 has arcuate slots 130 through which the rods 126 of the arm rests 124 are exposed (FIG. 7). Within the confines of these slots 130 set screws 132 thread into the rods 126, there being one set screw 132 at each slot 130. The screws 132 prevent the rods 126 from withdrawing from the ends of the tube 128. Moreover, the length and orientation of the two slots 130 is the same, it being such that when the screw 132 is at one end of the slot 130, the arm rest 124 which projects forwardly over the side of the seat cushion 114, and when it is at the other end, the arm rest 124 will extend upwardly along the back rest region 94 of the side panel 90 from which it projects. Thus, each arm rest 124 can move independently between an extended position, wherein it provides a convenient rest for the occupant's arm, to an elevated position where it does not obstruct the side of the seat cushion 114.

The chair A provides a comfortable seat for its occupant during a shampoo, yet enables the occupant's head to assume a convenient position at the shampoo bowl B. One enters the chair A with the chair form 16 in its lowest position and the leg rest 106 against the front edges of the side panels 90. One or both of the arm rests 124 may be raised to facilitate entry. After sitting on the seat cushion 114, the individual reclines slightly against the backrest 116. At this time the barber or beautician rotates the handle 110 to move the leg rest 106 to its generally horizontal position so as to support the occupant's legs. The backrest 116 may also be moved upwardly or downwardly simply by loosening the thumb wheel 122 and shifting the backrest 116 to a new position. Now the barber or beautician moves the chair form 16 until the occupant's neck rests comfortably in the depression 2 of the shampoo bowl B, so that the occupant's head is in effect over the bowl B. To this end, the barber or beautician elevates the chair form 16 until the occupant's head is at the proper elevation with respect to the shampoo bowl B, this being achieved simply by depressing the pedal 80 repeatedly until the chair form 16 reaches the proper elevation. The barber or beautician also moves the chair form 16 toward or away from the shampoo bowl B to bring the occupant's neck to a comfortable rest in the depression 2 of the bowl B. Of course, the carriage 12 must be free to move over the tracks 20 on the base 10, and if it exhibits a resistance to movement, the pedal 80 is simply depressed to release the locking elements 50 from the tracks 20. With the elements 50 released, the carriage 12 moves easily over the base 10 until the chair form 16 and its occupant are in the desired location. The user then elevates the pedal 80 to rotate the locking elements 50 to their locked positions where they bear against the tracks 20. This prevents the carriage 12 from moving on the base 10. The shampoo then proceeds at the shampoo bowl B, while the occupant remains comfortably seated and even somewhat reclined on the seat cushion 94 and leg rest 86 and against the backrest 96 of the chair form 16.

The chair A, instead of having the pump embodied in the cylinder 14, may be equipped with an electrically operated pump which is actuated by an electrical switch. Indeed, such a switch controls both the extension of the rod 62 from the barrel 60 and retraction into the barrel 60. When the chair A is so equipped, a modified carriage lock 140 (FIGS. 9–11) may be used. The modified lock 140, which also serves to replace one of the keepers 26, includes a bushing 142 which is attached to one of the tracks 20 above the carriage 12 with its axis extended transversely with respect to the track 20. In addition, the carriage lock 140 has a shaft 144 which lies within the bushing 142 and further projects beyond both ends of the bushing 142. At its inner end, the shaft 144 is fitted with an eccentric clamping element 146 which rotates with the shaft 144 between a locked position and an unlocked position. In the locked position, the element 146 bears against the adjacent side bar 30 of the carriage 12 and prevents the carriage 12 from moving along the tracks 20 of the base 10. In the unlocked position, the element 146 lies above the carriage 12 and does not interfere with movement of the carriage 12 along the tracks 20. However, in both positions the locking element 146 lies over that portion of the carriage side bar 30 that is along the track 20 on which it is mounted and prevents the carriage 12 from leaving that track 20. Thus, the keeper 26 and the locking element 146 together with the keeper 26 on the other track 20 hold the carriage 12 on the tracks 20 of the base 10, so that the carriage 12 will not be displaced from the base 10. Finally, the carriage lock 140 has an actuating pedal 148 which is attached to the shaft 144 beyond the outer end of the bushing 142. The pedal 148 lies on both sides of the shaft 144, so that when it is depressed on one side, it rotates the shaft 144 in one direction and when depressed on the opposite side, it rotates the shaft 144 in the opposite direction. Indeed, when the pedal 148 is depressed on one side it rotates the locking element 146 to its locked position, and when depressed on the other side, it rotates the locking element 146 to its unlocked position. The pedal 148 is exposed beyond one of the side panels 90 at the chair form 16.

This invention is intended to cover all changes and modifications of the example of the invention herein chosen for purposes of the disclosure which do not constitute departures from the spirit and scope of the invention.

What is claimed is:

1. A chair comprising: a base configured to rest on a floor and having two upwardly presented tracks which are parallel; a carriage mounted on the tracks for movement to and fro on the base, but not laterally, the carriage having side bars which lie along the tracks and cross members which extend transversely between and are attached to the side bars; a fluid-operated cylinder mounted on the cross members with its axis extended generally vertically; a chair form having a seat section and a back section, the seat section being attached to the fluid-operated cylinder, whereby the cylinder when activated will raise or lower the chair form; stabilizing elements attached to the carriage remote from the cylinder and contacting the chair form as the cylinder moves the chair form upwardly and downwardly, whereby the stabilizing elements prevent the chair form from rotating about the axis of the cylinder; a keeper attached to at least one of the tracks of the base and extended over that bar of the carriage that is along that one track; and locking means attached to the carriage for bearing against at least one of the tracks and thereby preventing the carriage from moving along the base.

2. The chair according to claim 1 wherein the locking means includes a shaft extended across the carriage, locking elements mounted on the ends of the shaft and located over the tracks, the locking element being eccentric to the shaft so that it will move against the underlying track when the shaft is turned and thereby prevent the carriage from moving along the vase, and means for imparting rotation to the shaft.

3. The chair according to claim 1 wherein the cylinder includes a pump and a lever for operating the pump, and the means for imparting rotation to the shaft of the locking means includes a crank arm on the shaft and a linkage connecting the lever of the cylinder and the crank arm of the shaft.

4. In combination with a shampoo bowl, a chair for comfortably positioning an individual for receiving a shampoo at the shampoo bowl, said chair comprising: a base located in front of the shampoo bowl and providing tracks which extend generally toward the bowl; a carriage mounted on the tracks of the base for movement on the base toward and away from the bowl; locking means for coupling the carriage to the base so that the carriage cannot move on the base; a chair form supported on the carriage and having sides, a generally horizontal seat portion and a back portion located at a substantial angle to the seat portion; a fluid-operated cylinder interposed between the carriage and the chair form for raising and lowering the chair form; and stabilizing arms projecting from the carriage and located along the sides of the chair form for preventing the chair form from rotating relative to the base about a generally vertical axis.

5. A chair according to claim 4 wherein the sides of the chair form generally obscure the cylinder and have substantially vertical inside faces and the stabilizing arms are located along those inside faces.

6. In combination with a shampoo bowl, a chair for comfortably positioning an individual for receiving a shampoo at the shampoo bowl, said chair comprising; a base located in front of the shampoo bowl and providing tracks which extend generally toward the bow; a carriage mounted on the tracks of the base for movement on the base toward and away from the bowl; locking means mounted on the carriage and being capable of bearing against at least one of the tracks for coupling the carriage to the base when the locking means bears against the track so that the carriage cannot move on the base; a chair form supported on the carriage and having a generally horizontal seat portion and a back portion located at a substantial angle to the seat portion; elevating means interposed between the carriage and the chair form for raising and lowering the chair form; and stabilizing means for preventing the chair form from rotating relative to the base about a generally vertical axis.

7. The combination according to claim 6 wherein the locking means includes a shaft which is mounted on the carriage for rotation about an axis that extends transversely with respect to the tracks, and an eccentric locking element on the shaft, the locking element being configured such that when turned in one direction it is separated from the track and does not interfere with movement of the carriage along the base, but when turned in the opposite direction bears against the track and prevents the carriage from moving on the base.

8. The combination according to claim 7 wherein the elevating means includes a hydraulic cylinder having a pump and further includes a lever for actuating the pump, and wherein the shaft of the locking means is connected to and operated by the lever of the elevating means.

9. In combination with a shampoo bowl, a chair for comfortably positioning an individual for receiving a shampoo at the shampoo bowl, said chair comprising: a base located in front of the shampoo bowl and providing parallel tracks which extend generally toward the bowl; a carriage mounted on the tracks of the base for movement on the base toward and away from the bowl, the carriage having two bars which lie along the tracks, wheels on the bars near the ends of the bars and supporting the bars on the tracks, and cross members extended between the two bars intermediate the wheels that are at the ends of the bars; locking means for coupling the carriage to the base so that the carriage cannot move on the base; a chair form supported on the carriage and having a generally horizontal seat portion and a back portion located at a substantial angle to the seat portion; a fluid operated cylinder mounted on the cross members of the carriage for raising and lowering the chair form; and stabilizing means for preventing the chair form from rotating relative to the base about a generally vertical axis.

10. The combination according to claim 9 wherein the base on its tracks has keepers which project over the bars of the carriage, whereby the carriage will not leave the base.

11. The combination according to claim 9 wherein the chair form has sides which extend downwardly and obscure the cylinder, a seat panel which is connected to the side panels and to the cylinder, and a back panel which is connected to the side panels and is oriented at a substantial angle with respect to the seat panel and the axis of the cylinder.

12. The combination according to claim 11 wherein the stabilizing means include arms attached to the carriage and located along the sides of the chair form.

13. The combination according to claim 12 wherein the arms are offset in the direction of carriage movement from the cylinder.

14. In combination with a shampoo bowl, a chair for comfortably positioning an individual for receiving a shampoo at the shampoo bowl, said chair comprising: a base located in front of the shampoo bowl and providing tracks which extend generally toward the bowl; a carriage mounted on the tracks of the base for movement on the base toward and away from the bowl; locking means for coupling the carriage to the base so that the carriage cannot move on the base, the locking means being mounted on one of the tracks and, when coupling the carriage to the base, bearing against the carriage; a chair form supported on the carriage and having a generally horizontal seat portion and a back portion located at a substantial angle to the seat portion; elevating means interposed between the carriage and the chair form for raising and lowering the chair form; and stabilizing means for preventing the chair form from rotating relative to the base about a generally vertical axis.

15. The combination according to claim 14 wherein the locking means includes a shaft which is mounted on one of the tracks for rotation about an axis that extends transversely with respect to the tracks, and an eccentric locking element mounted on the shaft for rotation with the shaft, the locking element being configured such that when turned in one direction, it is separated from the carriage and does not interfere with movement of the carriage along the base, but when turned in the opposite direction bears against the track and prevents the carriage from moving on the base.

16. The combination according to claim 15 wherein the locking element projects over a portion of the carriage and serves to retain the carriage on the base.

17. A chair comprising: a base providing tracks; a carriage mounted on the tracks of the base for movement to and fro on the base; locking means for coupling the carriage to the base so that the carriage cannot move on the base; a chair form supported on the carriage and having a generally horizontal seat portion and a back portion located at a substantial angle to the seat portion; a fluid-operated cylinder located between the carriage and the chair form for raising and lowering the chair form and including a pump; an actuating member for operating the pump when moved to and fro, the member being connected to the locking means for causing the locking means to couple the carriage to the base when the member is moved in one direction; and stabilizing means for preventing the chair form from rotating relative to the base about the axis of the cylinder.

18. A chair according to claim 17 wherein the locking means includes a shaft which is mounted on the carriage for rotation about an axis that extends transversely with respect to the tracks, and an eccentric locking element on the shaft, the locking element being configured such that when turned in one direction it is separated from the track and does not interfere with movement of the carriage along the base, but when turned in the opposite direction bears against the track and prevents the carriage from moving on the base.

19. A chair according to claim 18 wherein the shaft has a crank arm and a linkage connects the crank arm of the shaft to the actuating member.

* * * * *